US008613243B2

(12) United States Patent
Gonard et al.

(10) Patent No.: US 8,613,243 B2
(45) Date of Patent: Dec. 24, 2013

(54) STANDOFF PROTECTION DEVICE INTENDED TO FULLY COVER A DOOR

(75) Inventors: Ulric Gonard, Pouilly les Nonains (FR); Sébastien Carrie, Guyancourt (FR); François-Xavier Querry, Tarcenay (FR)

(73) Assignee: Nexter Systems, Roanne (FR)

( * ) Notice: Subject to any disclaimer, the term of this patent is extended or adjusted under 35 U.S.C. 154(b) by 202 days.

(21) Appl. No.: 13/311,067

(22) Filed: Dec. 5, 2011

(65) Prior Publication Data

US 2012/0137866 A1 Jun. 7, 2012

(30) Foreign Application Priority Data

Dec. 7, 2010 (FR) ..... 10 04778

(51) Int. Cl.
*F41H 7/02* (2006.01)

(52) U.S. Cl.
USPC ..... 89/36.08; 89/930

(58) Field of Classification Search
USPC ..... 89/36.01–36.11
See application file for complete search history.

(56) References Cited

U.S. PATENT DOCUMENTS 5,025,707 A * 6/1991 Gonzalez ..... 89/36.17
6,805,035 B2 * 10/2004 Edberg et al. ..... 89/36.17
6,901,839 B2 * 6/2005 Edberg et al. ..... 89/36.17
7,866,250 B2 * 1/2011 Farinella et al. ..... 89/36.17
7,914,069 B2 * 3/2011 Barbe et al. ..... 296/193.07
8,011,285 B2 * 9/2011 Farinella et al. ..... 89/36.08
8,245,620 B2 * 8/2012 Farinella et al. ..... 89/36.08
8,245,621 B2 * 8/2012 Farinella et al. ..... 89/36.08
8,245,622 B2 * 8/2012 Farinella et al. ..... 89/36.08
8,443,709 B2 * 5/2013 Farinella et al. ..... 89/36.08
8,464,627 B2 * 6/2013 Farinella et al. ..... 89/36.08
8,468,927 B2 * 6/2013 Malone et al. ..... 89/36.08
2009/0266227 A1 10/2009 Farinella et al.

FOREIGN PATENT DOCUMENTS

EP 1 944 566 A1 7/2008
WO WO 2009/064263 A2 5/2009

OTHER PUBLICATIONS

French Search Report issued in French Patent Application No. 10 04778 on Jul. 26, 2011 (with translation).

* cited by examiner

*Primary Examiner* — Michael David
(74) *Attorney, Agent, or Firm* — Oliff & Berridge, PLC

(57) ABSTRACT

A standoff protection device intended to fully cover a door and incorporating an opening panel giving access to the door, the opening panel and door each comprising a hinge whose axes of rotation are parallel to one another, wherein the opening panel is wider than the door and is positioned facing the door such that said opening panel completely covers the door, the axis of rotation of the door namely facing the opening panel, the opening panel further incorporating at least one slide perpendicular to the axis of rotation of the opening panel, the slide being connected to the door by an arm integral with the door.

9 Claims, 6 Drawing Sheets

STANDOFF PROTECTION DEVICE INTENDED TO FULLY COVER A DOOR

BACKGROUND OF THE INVENTION

1. Field of the Invention

The technical scope of the invention is that of standoff ballistic protection devices to protect doors, and in particular doors of military vehicles.

2. Description of the Related Art

To protect military vehicle from projectiles and explosive devices attacking by means of hollow charges or shaped charges, ballistic protections are installed at a distance from the external walls of the vehicle.

These protections are often termed "slats" and consist in placing gridding, parallel bars, or simple louvered panels or even netting at a distance of between 200 and 400 mm around the vehicle and possibly above the vehicle. The aim of this protection is to perturb the triggering of projectiles before they reach the vehicle itself.

These protections are also placed in front of the doors and access hatches of the vehicle. With respect to the doors, it is obvious that the protection should not hinder the door's opening and closing to allow the crew to enter or exit the vehicle, but above all the door protection must be able to be installed or removed by the crew, without the need for assistance of a person outside the vehicle, for the crew to be able to enter or exit autonomously.

For this, it is known to fix a standoff ballistic protection panel that is fastened to the vehicle door so that the protection follows all the movements of the door. This solution presents the major disadvantage of requiring a non-protected zone around the door to enable its opening and closing movements. In other terms, this solution causes an absence of protection in proximity to the door hinges, this in order to be able to pivot the door without the protection fastened to the door interfering with the protection elements fastened to the vehicle and placed close by.

Patent EP-1944566 discloses a standoff protection device surrounding a vehicle. This device incorporates hinges at the joining point of each panel that enable the protection panels to fold with respect to one another in a similar way to the bellows of an accordion. This way of folding the panels provides access to the vehicle's side doors from the exterior.

We see that this solution is not totally satisfactory since, from the inside of the vehicle, the crew is not able to open or close the panel placed facing the door.

SUMMARY OF THE INVENTION

To overcome the problem of the full ballistic protection of the door, as well as of the opening of such protection from inside the vehicle, the invention proposes to arrange a protection panel for the vehicle such that it becomes an opening panel. This ballistic protection opening panel is furthermore equipped with a slide hooked to an arm integral with the door. The arm thus allows the opening panel to follow the movement of the door, thanks to the slide, and this without causing interference.

According to other characteristics, the invention also proposes means to facilitate the opening of the door from the exterior of the vehicle. For this, the slide may be hooked and unhooked to the arm from the exterior of the vehicle.

Thus, the invention relates to a standoff protection device intended to fully cover a door and incorporating an opening panel giving access to the door, opening panel and door each comprising hinge means whose axes of rotation are parallel to one another, device wherein the opening panel is wider than the door and is positioned facing the door such that the opening panel completely covers the door, the axis of rotation of the door namely facing the opening panel, the opening panel further incorporating at least one slide perpendicular to the axis of rotation of the opening panel, the slide being connected to the door by rigid hooking means integral with the door.

Advantageously, the slide(s) may be made integral with the opening panel by at least one pivot link able to be activated by control means, the pivoting of the slide(s) enabling these to be engaged or disengaged from a hook shape carried at the end of the hooking means.

According to one characteristic, the hooking means incorporates at its end directed towards the opening panel at least one slope on which the slide comes to rest, slope oriented so as to guide the slide to the inside of the hook shape.

Advantageously, the pivot link incorporates means to bring the slide back to the bottom of the hook shape.

According to one characteristic, the control means incorporates at least one control rod integral with the slide by a first end and integral with a handle by a second end.

Advantageously, the device incorporates two slides that are activated by the same control rod.

According to another characteristic, the distance D between the axis of rotation of the door and the orthogonal projection of the axis of rotation of the opening panel in the plane of the door is substantially equal to the standoff distance separating the door from the opening panel.

BRIEF DESCRIPTION OF THE DRAWINGS

The invention will become more apparent from the following description made with reference to the appended drawings, in which.

DETAILED DESCRIPTION OF PREFERRED EMBODIMENTS

Figure 1:
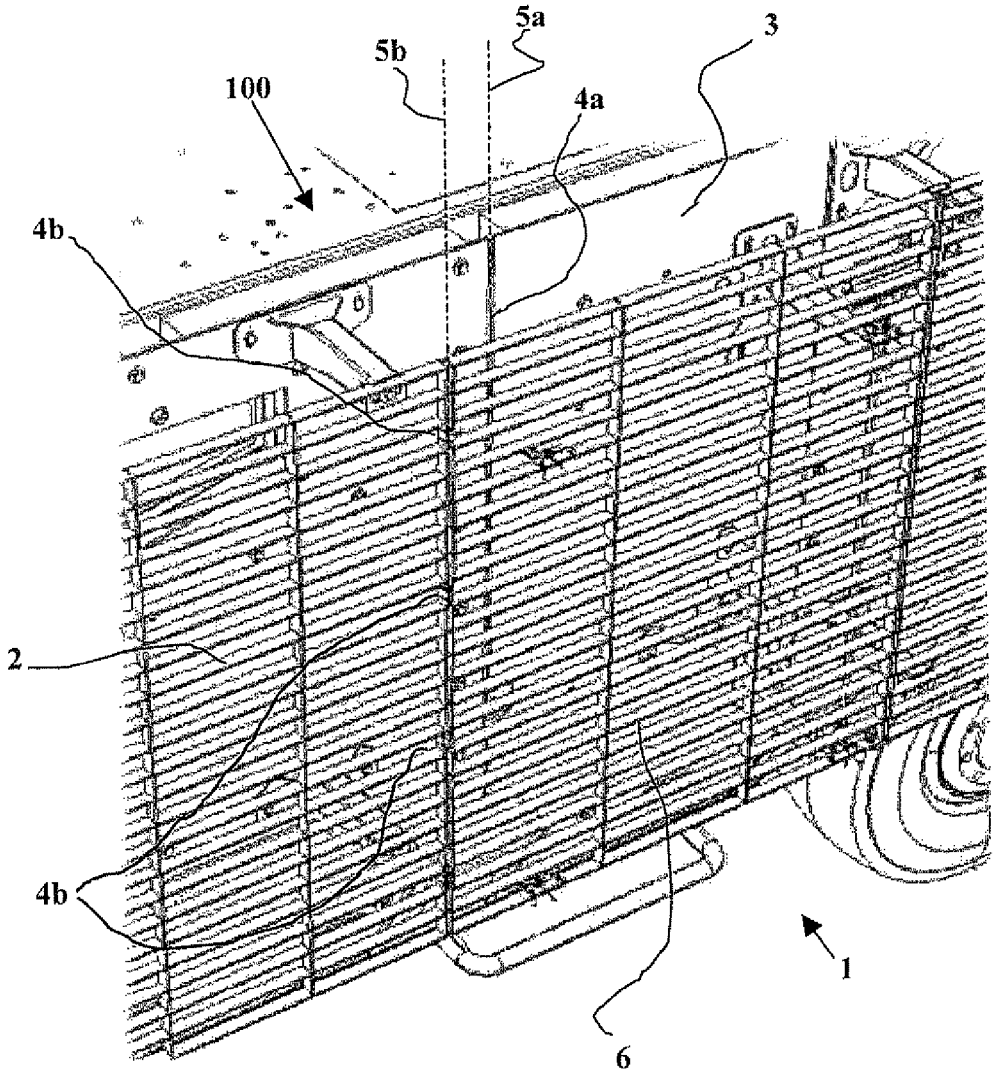
FIG. 1 shows a three-quarter view of the device in the closed position, mounted on an armored vehicle.

According to FIG. 1, and according to one embodiment, an armored vehicle 100 is equipped on its perimeter by standoff ballistic protection means 2. These standoff ballistic protection means 2 are in the form of a panel incorporating louvered slats protecting a side door 3 of the vehicle 100. This door 3 incorporates hinges 4*a* with vertical axes of rotation 5*a*. This door 3 is protected by a ballistic protection panel forming an opening panel 6 hinged by second hinges 4*b* with an axis of rotation 5*b*. The axes of rotation 5*a* and 5*b* of the door 3 and the opening panel 6 are parallel to one another.

Figure 2:
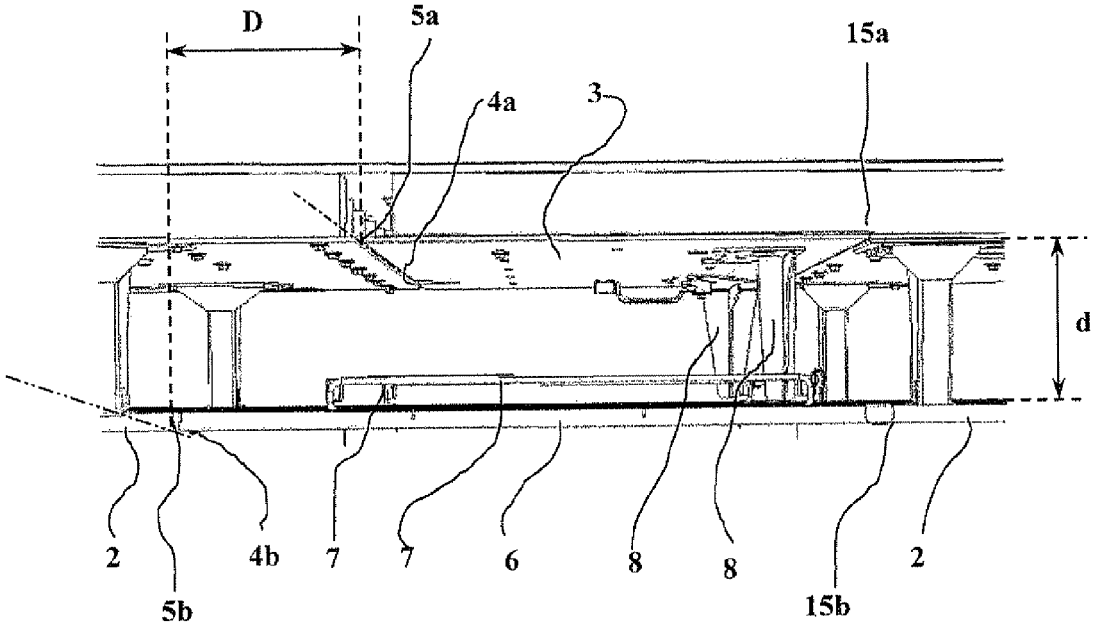
FIG. 2 shows a top view of the device in the closed position and mounted on an armored vehicle.

According to FIG. 2, the hinges 4*b* of the opening panel 6 are linked to other fixed panels of the standoff ballistic protection 2. Two slides 7, perpendicular to the axes of rotation 5*a* and 5*b* of hinges 4*a* and 4*b*, are integral with the internal face of the opening panel 6 (the slides can be better seen in FIG. 6). The opening panel 6 and the door 3 are shown in their closed position. The slides 7 are each linked to the door 3 by an arm 8 that constitutes rigid hooking means 8 integral with the door 3.

Figure 3:
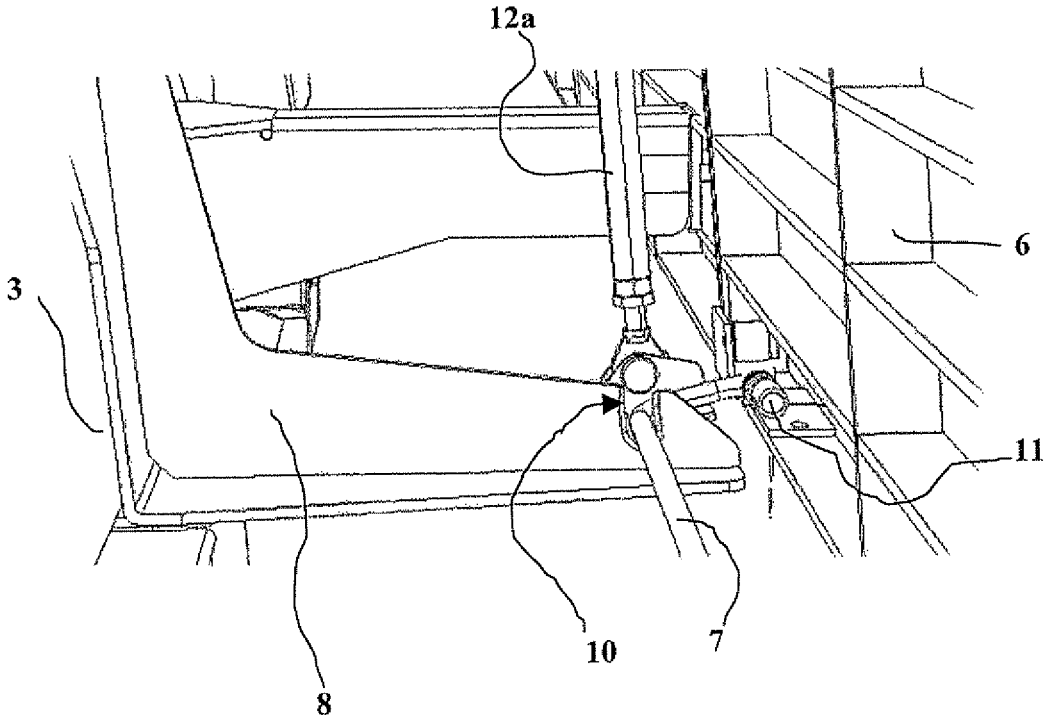
FIG. 3 shows a view of a detail located between the vehicle and the device in the locked position.

According to FIG. 3, the arm 8 incorporates a notch 10 in a hook shape corresponding with the slide 7. The hook shape 10 reduced the freedom of movement of the slide 7 namely in the opening direction of the opening panel 6. The opening panel is thus in its locked position when the slide 7 is in the notch 10.

The slide 7 incorporates a pivot link 11 at each of its ends (only one link can be seen in FIG. 3), links which join it to the opening panel 6. Control means 12 (which can be better seen in FIG. 6) incorporate a control rod 12*a* linked to the slide 7 by a first end and to an opening handle 6 (handles not shown in the Figure) by its second end. These control means 12 enable the two slides 7 to be simultaneously disengaged from the hook shapes 10 by rotating the slides 7 around their pivot links 11. By activating the control means 12, the opening panel 6 is unlocked. Note that the hook shape 10 does not oppose a possible translational movement of the slide 7 with respect to the hook shape 10, movement whose use will be explained during the description of FIG. 6. The opening of the door 3 thus activates the opening of the panel 6, each hook 10 sliding on its slide 7.

Figure 4:
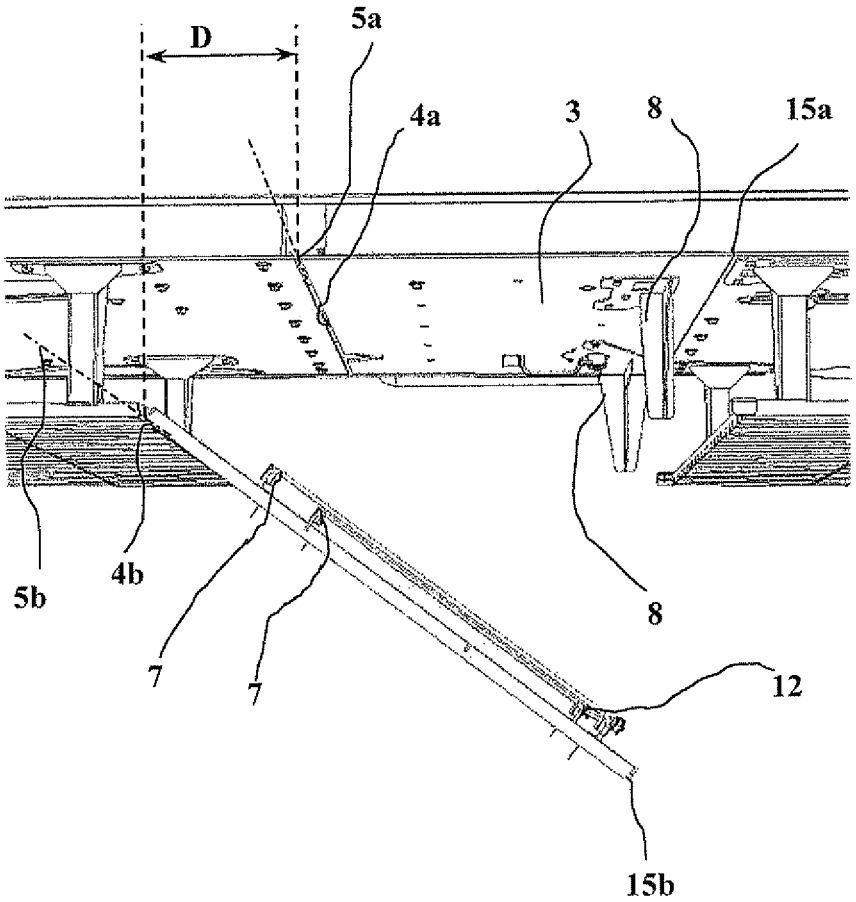
FIG. 4 shows a top view of the device in its open protection position mounted on an armored vehicle.

In FIG. 4 only the opening panel 6 is shown in the open position. Each slide 7 has been unhooked from the 8 linking it to the door 3. Unhooking of the arm 8 is performed as explained previously. Unhooking is performed simultaneously for each slide 7 by activating the control means 12. In this way, the crew located to the exterior of the vehicle may access the door 3 and open it to get in, for example.

Figure 5:
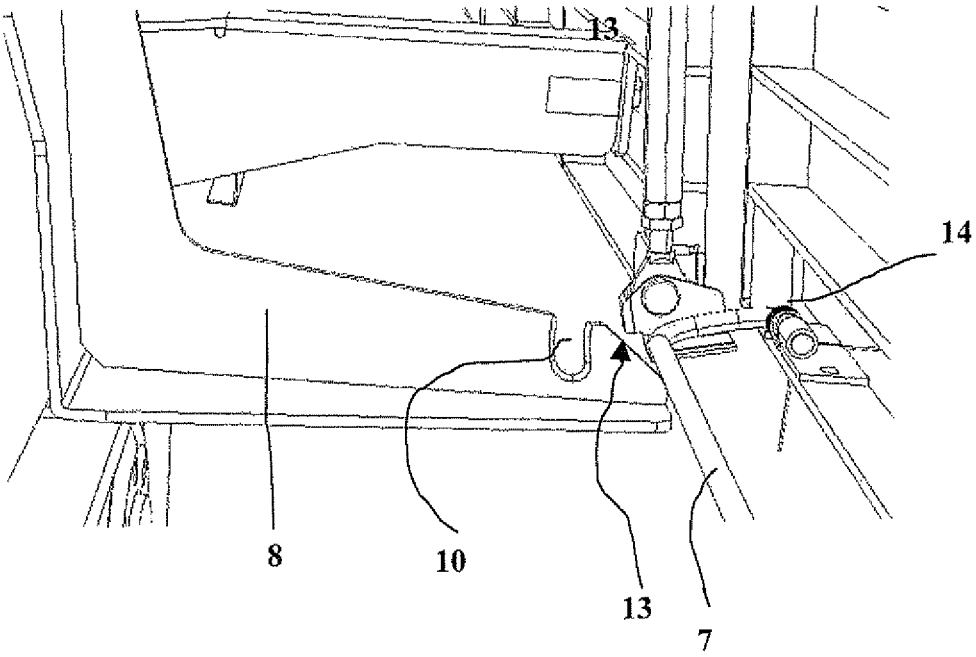
FIG. 5 shows a view of a detail located between the vehicle and the device in the unlocked position.

According to FIG. 5, the arm 8 incorporates a sliding slope 13 inclined so as to guide the slide 7 to the hook shape 10. Closing the opening panel 6 causes the slide 7 to gradually rise along the slide rail 13. When it has stopped rising, the slide is pushed back into the bottom of the hook shape 10 by being made to rotate around its pivot link 11 thanks to return means 14 constituted here by a spring 14. The opening panel 6 may thus be closed from the exterior.

Figure 6:
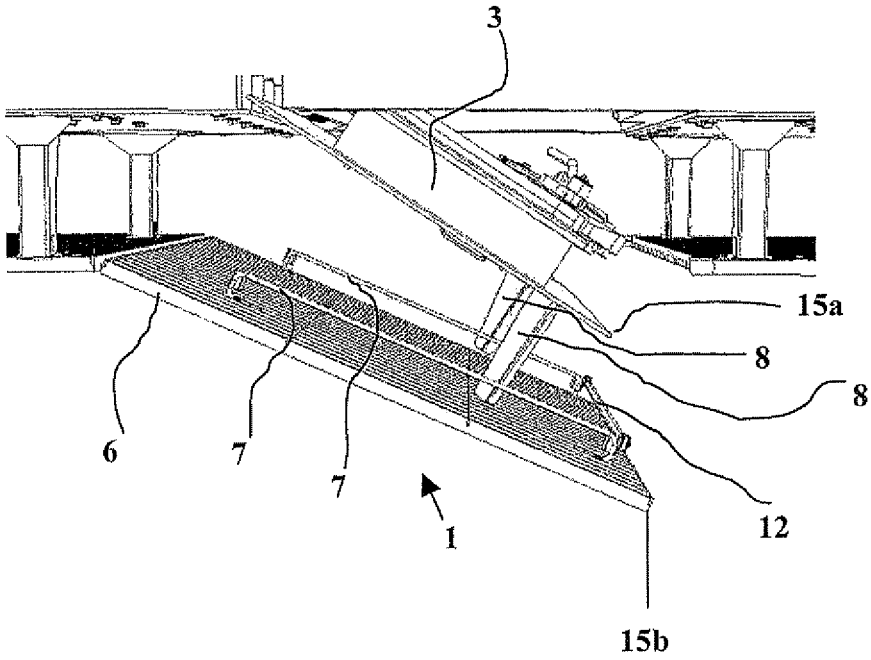
FIG. 6 shows a top view of the device with the vehicle door open.

FIG. 6 shows the vehicle door 3 open and linked to the opening panel 6. The door 3 and opening panel 6 are joined together by arms 8 hooked to the slides 7. The closing or opening movement of the door activates the sliding of the arms 8 along each of the slides 7, thereby obliging the opening panel 6 to follow an opening movement that mirrors that of the door 3.

With reference to FIG. 2, the orthogonal protection of the axis of rotation 5*b* of the opening panel on the plane of the door 3 makes a projected distance D appear between the two axes of rotation 5*a* and 5*b*. Note that the axis of rotation of the door 5*a* is placed facing the opening panel 6. This condition is necessary to obtain a satisfactory opening angle for the door. The greater the distance D the wider the maximal opening angle of the door.

In the case shown, the distance D is chosen to be slightly greater than the distance d separating the opening panel 6 and the door 3 to obtain an opening angle of approximately 90°.

Furthermore, the opening panel 6 is wider than the door 3 and is positioned facing the door such that the opening panel 6 completely covers the door 3. The external edge 15*a* of the door faces the opening panel 6 or is substantially aligned in the closed position with the external edge 15*b* of the opening panel. This is to avoid mechanical interference between the door 3 and the protection 2 when the door is being opened.

The crew may, in this way, open or close the door 3 from the interior of the vehicle without the need for external intervention and in one operation (that is to say without the successive opening of the door 3 and then that of the opening panel 6, or vice versa).

According to another embodiment not shown, the device 1 may be used for opening panels 6 protecting horizontally positioned doors 3 on the roof of a vehicle, for example. This device 1 also works for doors 3 and opening panels 6 having non vertical axes of rotation 5 of the disembarkation bay type.

This device 1 can be used for all types of standoff protections, be they slat type protections as in the enclosed Figures, or grid or net type protections as are commonly encountered, or even solid panels.

What is claimed is:

1. A standoff protection device configured to fully cover a door and incorporating an opening panel giving access to the door, said opening panel and door each comprising a hinge whose axes of rotation are parallel to one another, wherein said opening panel is wider than said door and is positioned facing said door such that said opening panel completely covers said door, said axis of rotation of said door namely facing said opening panel, said opening panel further incorporating at least one slide perpendicular to said axis of rotation of said opening panel, said slide being connected to said door by an arm integral with said door.

2. Standoff protection device according to claim 1, wherein said at least one slide is made integral with said opening panel by at least one pivot link able to be activated by a control portion, the pivoting of said at least one slide enabling it to be engaged or disengaged from a hook shape carried at the end of said arm.

3. Standoff protection device according to claim 2, wherein said arm incorporates at its end directed towards said opening panel at least one slope on which said slide comes to rest, said slope being oriented so as to guide said slide to the inside of the shape of said hook.

4. Standoff protection device according to claim 2, wherein said pivot link incorporates a spring to bring said slide back to the bottom of the shape of said hook.

5. Standoff protection device according to claim 2, wherein said control portion incorporates at least one control rod integral with said slide by a first end and integral with a handle by a second end.

6. Standoff protection device according to claim 5, wherein said device incorporates two slides that are activated by the same said at least one control rod.

7. Standoff protection device according to claim 1, wherein the distance (D) between said axis of rotation of said door and the orthogonal projection of said axis of rotation of said opening panel in the plane of said door is substantially equal to the standoff distance (d) separating said door from said opening panel.

8. Standoff protection device according to claim 3, wherein said pivot link incorporates a spring to bring said slide back to the bottom of the shape of said hook.

9. Standoff protection device according to claim 4, wherein said control portion incorporates at least one control rod integral with said slide by a first end and integral with a handle by a second end.

* * * * *